US005842773A

United States Patent [19]

Krebs

[11] Patent Number: 5,842,773

[45] Date of Patent: Dec. 1, 1998

[54] BULB MOUNTING DEVICE, APPARATUS AND METHOD

[76] Inventor: Jimmy M. Krebs, 675 Lakeview Pkwy., Vernon Hills, Ill. 60061

[21] Appl. No.: 957,866

[22] Filed: Oct. 27, 1997

[51] Int. Cl.[6] ..... F21V 21/00

[52] U.S. Cl. ..... 362/249; 362/250; 362/396

[58] Field of Search ..... 362/249, 250, 362/252, 396, 389, 812

[56] References Cited

U.S. PATENT DOCUMENTS 5,755,508 5/1998 Wheaton ..... 362/249

5,788,362 8/1998 Chou ..... 362/249

*Primary Examiner*—Stephen Husar

*Attorney, Agent, or Firm*—Douglas B. White

[57] ABSTRACT

There is described herein a bulb mounting method including bulb mounting device in the form of a pair of hollow half cylinders hinged together along one edge and arranged to substantially envelop a bulb socket. Protruding flanges on the half cylinders are positioned to catch against the rear surface of a mounting board when the device is inserted into a receptacle hole, and tab members are positioned on the half cylinders forward of the flanges, to be inserted through the receptacle hole and to catch against the front surface of the mounting board.

20 Claims, 4 Drawing Sheets

FIG. 4
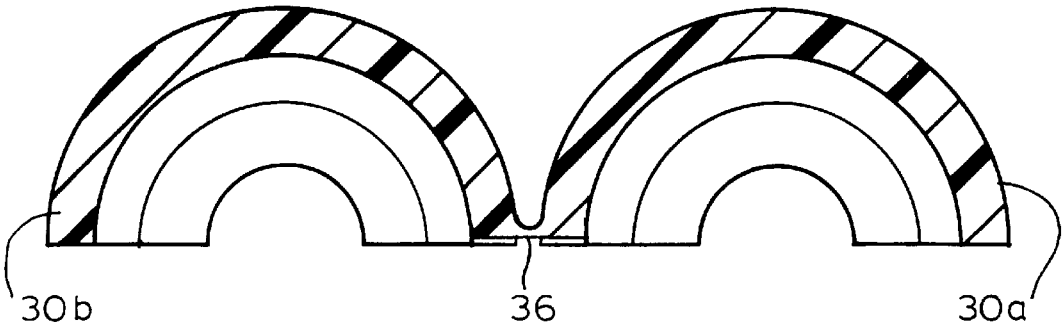
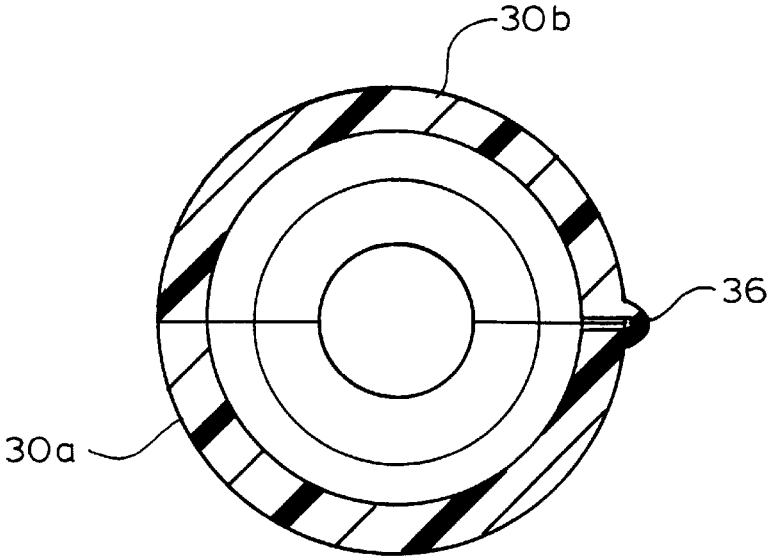
FIG. 5

BULB MOUNTING DEVICE, APPARATUS AND METHOD

BACKGROUND OF THE INVENTION

1. Field of the Invention

This invention relates generally to bulbs used for decorative lighting and more particularly to apparatus (and method) for mounting the bulbs for decorative or other display purposes.

2. Description of the Prior Art

In the prior art, decorative bulbs have generally been mounted by the use of wires or adhesive to the object to be so decorated. In the craft industry, it has become desirable to mount decorative bulbs on objects, such as mounting boards, yet no device has been developed to date which effectively and efficiently facilitates such mounting.

SUMMARY OF THE INVENTION

Accordingly it is the principal objective of this invention to provide apparatus (and method) for the decorative mounting of bulbs and a bulb mounting device which adapts the sockets of bulbs for mounting into receptacle openings. It is a further object to provide an efficient, cost effective device and method which is also easy to apply.

These and other objectives are achieved by a mounting board with receptacle holes therein and a bulb mounting device. This bulb mounting device is in the form of a pair of hollow half cylinders hinged together along one edge and arranged to substantially envelop the bulb socket. Protruding flanges on the half cylinders are positioned to catch against the rear surface of the mounting board when the device is inserted into the receptacle hole, and flexible tab members are positioned on the half cylinders forward of the flanges, to be inserted through the receptacle hole and then to catch against the front surface of the mounting board.

BRIEF DESCRIPTION OF THE DRAWINGS

FIG. 4 is a cross section of the mounting device, without the bulb or socket, in its open position, showing the hinge between the half cylinders.

FIG. 5 is a cross section of the mounting device, without the bulb or socket, in its closed position, showing the hinge between the half cylinders.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Figure 1:
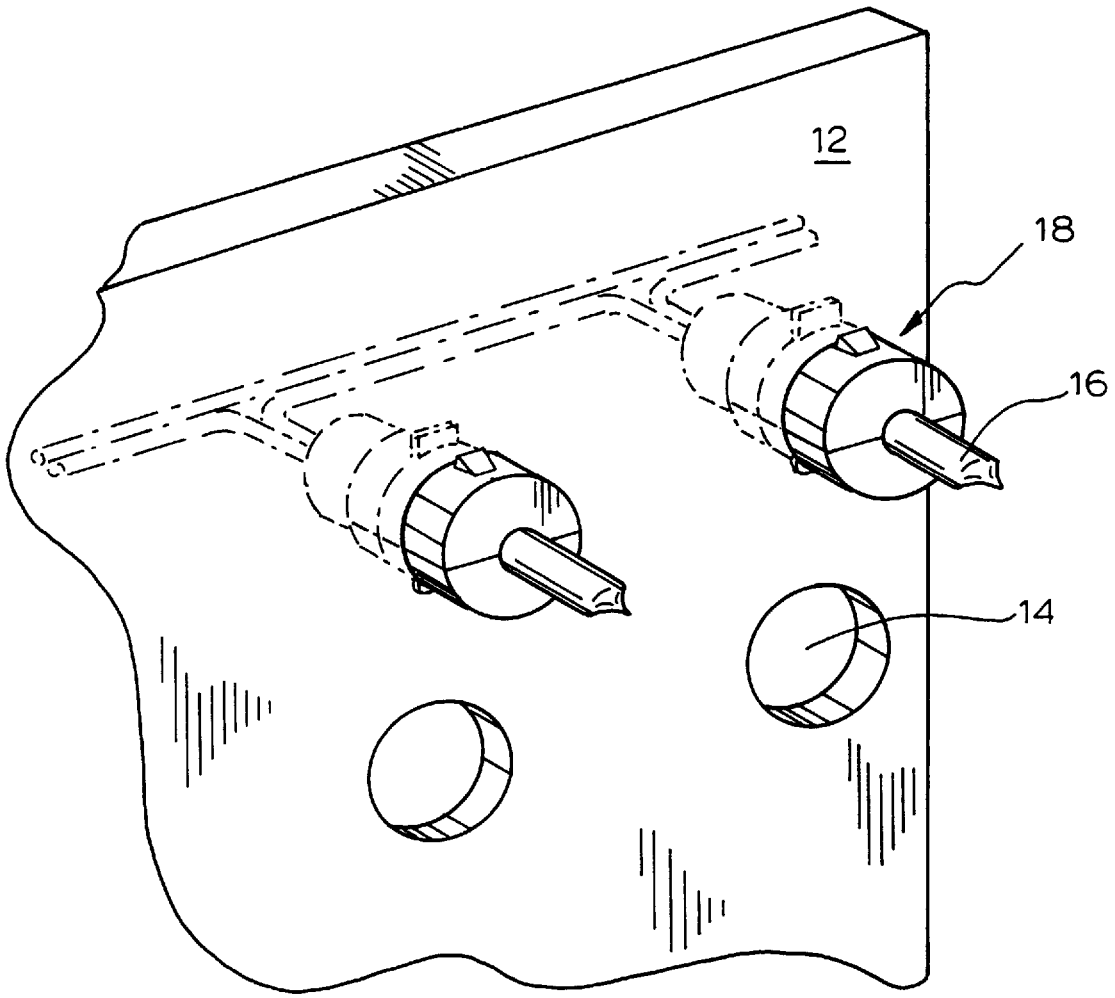
FIG. 1 is a perspective view of mounted bulbs employing the mounting device of the present invention.

Turning first to FIG. 1 there is shown a mounting board 12 having receptacle holes 14 for receipt of decorative lights 16. In accordance with the present invention, a mounting device 18 is employed to substantially envelop each bulb socket and to fit within a respective receptacle hole in the mounting board, as hereinafter described.

Figure 2:
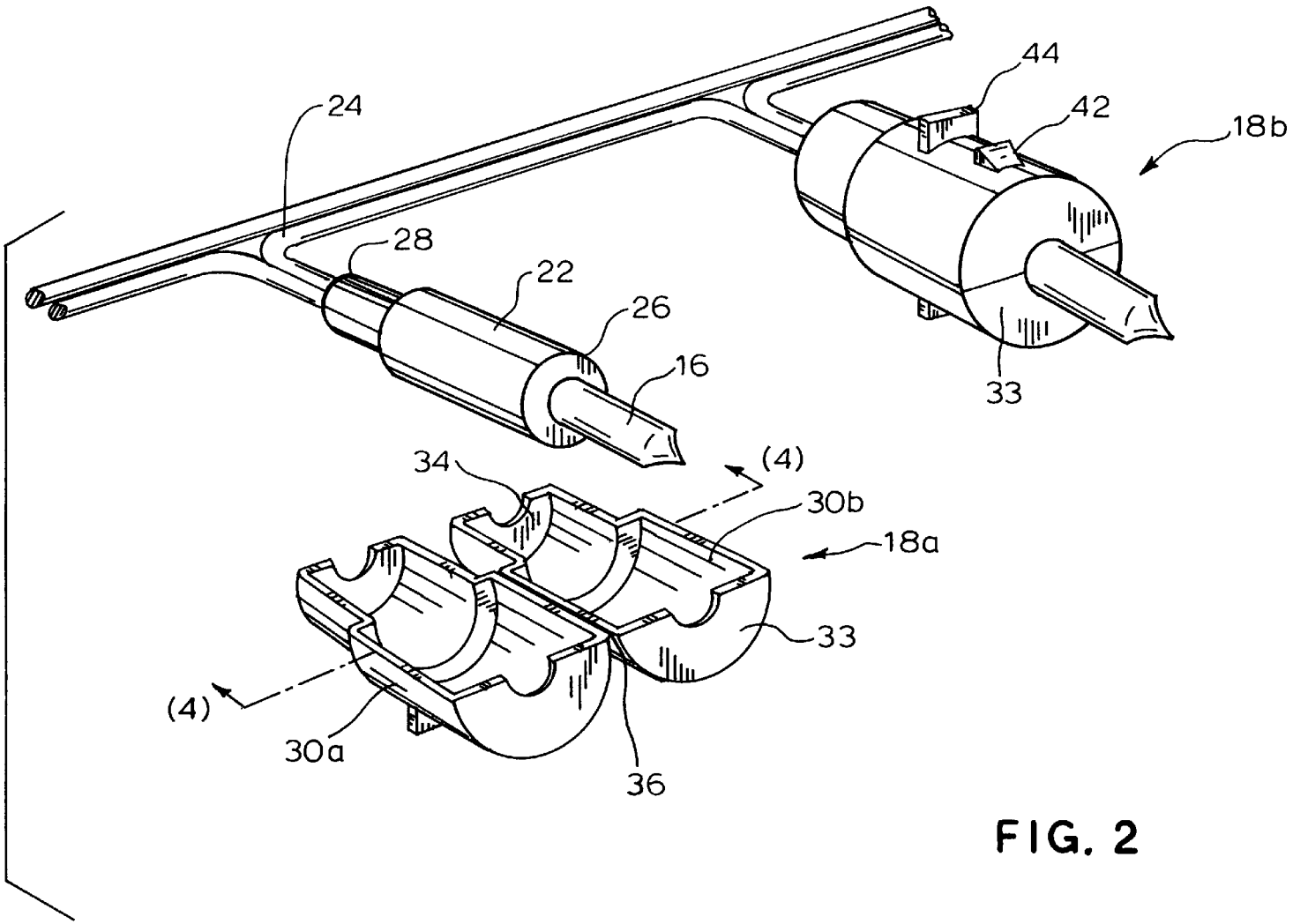
FIG. 2 is a perspective view of a string of decorative bulbs showing employment of the mounting device of the present invention.

As shown in FIG. 2, a light bulb 16 is carried in an electrical socket 22 and connected to wires 24 for supply of electrical current. The socket 22 is generally cylindrical in shape with a forward shoulder 26 and a rearward shoulder 28.

The mounting device of the present invention (shown open 18*a* and closed 18*b* in FIG. 2) is a hollow enclosure and in the preferred embodiment exhibits a cylindrical shape. This hollow enclosure is composed of two mating hollow members 30*a* and 30*b* hinged along a common edge to allow the hollow members to close around the bulb socket and form the enclosure. When the mounting device is closed around a socket, a forward lip 33 and a rearward lip 34 of the mounting device traps the bulb socket therebetween. In the preferred embodiment, the mating hollow members are half cylinders in shape and are hinged together along an adjacent edge 36. Moreover, the hinged connection 36 between the two half cylinders comprises a thinned wall section separating the two half cylinders, (FIG. 4 and FIG. 5) thereby allowing the thin wall to flex and to provide a hinge action. Such a flexible hinge can be molded from plastic along with the hollow members of the mounting device as an integral unit.

Figure 3:
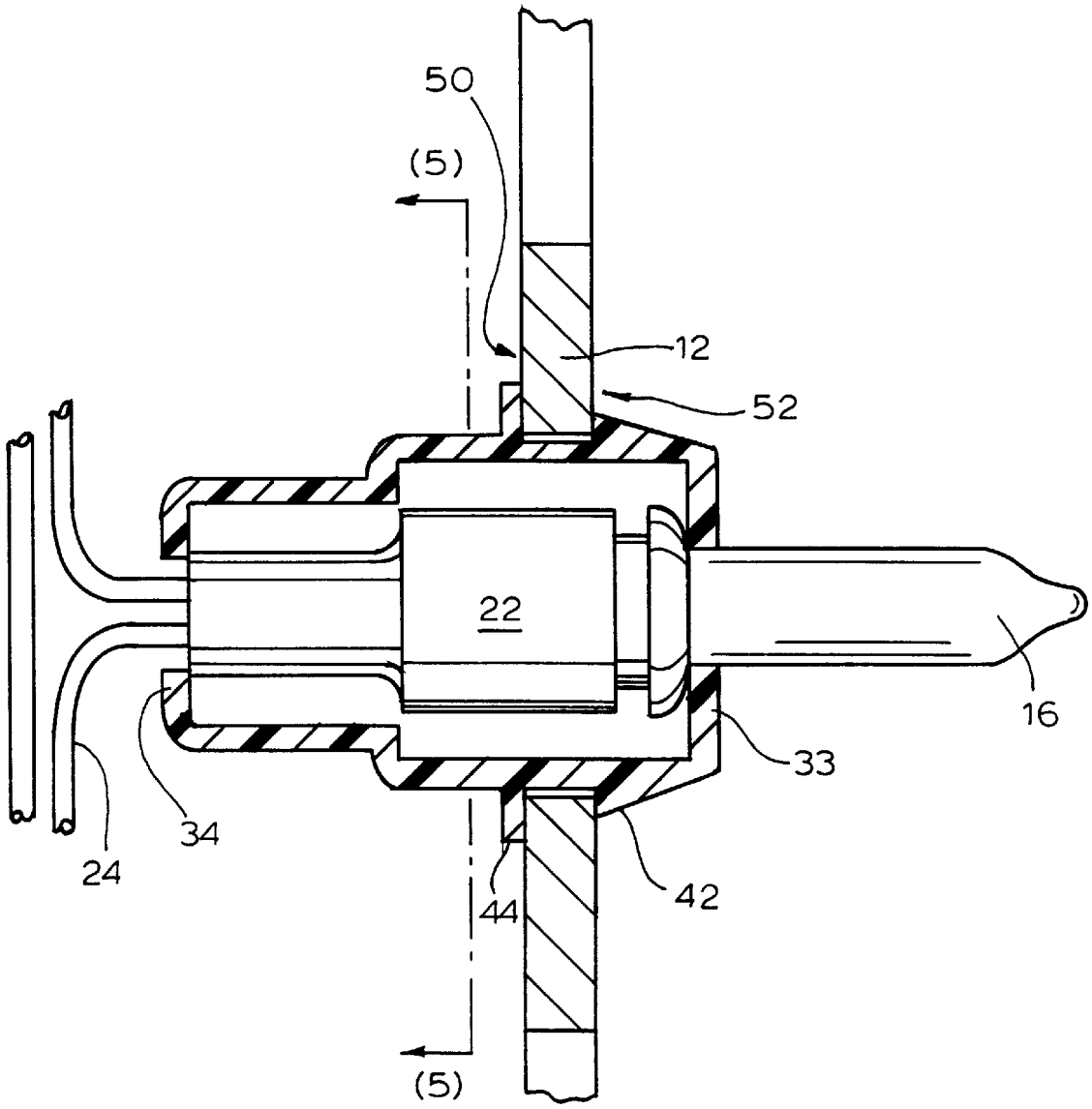
FIG. 3 is a cross section view of a mounted bulb of FIG. 1.

Along the sides of the mounting device (see FIG. 3) are forward flexible tab members 42 and rearward flange members 44 positioned such that they will trap the mounting board between them when the bulb socket is inserted into the receptacle hole. Once the half cylinders are closed around the bulb socket (FIG. 2), the mounting device is pushed into a receptacle hole from the rear 50 (wiring side) of the mounting board (see FIG. 1 and FIG. 3). During this insertion, the forward tabs 42 yield to pass through the receptacle hole, and insertion of the mounting device continues until the rearward flanges 44 catch on the rear side 50 of the mounting board 12. At this point the forward tabs 42 have cleared the front side 52 of the mounting board and return to their original shape and position, trapping the mounting board between the forward tabs and the rearward flanges. In the preferred embodiment, the entire mounting device, including tabs, flanges, hollow half cylinders, lips and hinge are all molded together as an integral unit.

From the foregoing description, it will be apparent that modifications can be made to the apparatus and method for using same without departing from the teachings of the present invention. Accordingly, the scope of the invention is only to be limited as necessitated by the accompanying claims.

What is claimed is:

1. A mounting device for securing a bulb socket within a receptacle hole of a mounting member, the mounting member having a front and rear surface defined thereon, the mounting device comprising:

first and second hollow members hinged together along an adjacent side for forming an enclosure for the bulb socket;

flanges protruding from said hollow members for abutting the rear surface of the mounting member when said mounting device is inserted into the receptacle hole; and flexible tab members protruding from said hollow members and spaced from said flanges for passing through the receptacle hole during insertion of said mounting device into the receptacle hole and for abutting the front surface of the mounting member when said mounting device is inserted into the receptacle hole.

2. The mounting device of claim 1 wherein each of said hollow members comprise a half cylinder shape with defined forward and rearward ends.

3. The mounting device of claim 2 wherein each of said half cylinders exhibit lips at said respective forward and rearward ends thereof.

4. The mounting device of claim 1 wherein said hinged connection between said first and second hollow members comprises a thinned wall section.

5. The mounting device of claim 4 wherein said mounting device is molded from plastic as an integral unit.

6. The mounting device of claim 4 wherein each of said hollow members exhibit a half cylinder shape and have forward and rearward lips defined thereon.

7. The mounting device of claim 6 wherein said mounting device is molded from plastic as an integral unit.

8. A decorative lighting assembly for mounting electrical bulb sockets, comprising:

a mounting member having a front and rear surface defined thereon and receptacle holes defined therein;

a mounting device for substantially enclosing and mounting the bulbs, said mounting device comprising;

(a) first and second hollow members hinged together along an adjacent side for forming an enclosure for the bulb socket;

(b) flanges protruding from said hollow members for abutting said rear surface of said mounting member when said mounting device is inserted into said receptacle hole; and (c) flexible tab members protruding from said hollow members and spaced from said flanges for passing through said receptacle hole during insertion of said mounting device into said receptacle hole and for abutting said front surface of said mounting member when said mounting device is inserted into said receptacle hole.

9. The mounting device of claim 8 wherein each of said hollow members exhibit a half cylinder shape having defined forward and rearward ends.

10. The mounting device of claim 9 wherein each of said half cylinders exhibit lips at respective forward and rearward ends thereof.

11. The mounting device of claim 8 wherein said hinge between said first and second hollow members comprises a thinned wall section.

12. The mounting device of claim 11 wherein said mounting device is molded from plastic as an integral unit.

13. The mounting device of claim 11 wherein each of said hollow members exhibit a half cylinder shape and have forward and rearward lips defined thereon.

14. The mounting device of claim 13 wherein said mounting device is molded from plastic as an integral unit.

15. A method for mounting electrical bulb sockets, comprising:

providing receptacle holes in a mounting member, said mounting member having a front and rear surface defined thereon;

substantially enclosing a bulb socket within a mounting device, said mounting device comprising;

(a) first and second hollow members hinged together along an adjacent side for forming an enclosure for said bulb socket, (b) flanges protruding from said hollow members for abutting said rear surface of said mounting member when said mounting device is inserted into said receptacle hole, and (c) flexible tab members protruding from said hollow members, spaced from said flanges, for passing through said receptacle hole and for abutting said front surface of said mounting member when said mounting device is inserted into said receptacle hole; and inserting said mounting device into said receptacle hole until said flanges abut said rear surface of said mounting member and said tab members abut said front surface of said mounting member.

16. The method of claim 15 wherein each of said hollow members exhibit a half cylinder in shape and have forward and rearward ends defined thereon.

17. The method of claim 16 wherein each of said half cylinders exhibit lips at respective forward and rearward ends thereof.

18. The method of claim 15 wherein said hinged connection between said first and second hollow members comprises a thinned wall section.

19. The method of claim 18 wherein said mounting device is molded from plastic as an integral unit.

20. The method of claim 17 wherein said hinged connection between said first and second hollow members comprises a thinned wall section and wherein said mounting device is molded from plastic as an integral unit.

* * * * *